United States Patent [19]

Mitchell et al.

[11] 4,033,896

[45] July 5, 1977

[54] METHOD OF CORROSION INHIBITION AND COMPOSITIONS THEREFOR

[75] Inventors: Robert S. Mitchell, Webster Groves; Thomas M. King, Creve Coeur, both of Mo.

[73] Assignee: Monsanto Company, St. Louis, Mo.

[22] Filed: June 18, 1976

[21] Appl. No.: 697,503

[52] U.S. Cl. ..... 252/389 A; 21/2.7 A; 252/8.55 E; 252/181; 260/502.5

[51] Int. Cl.[2] ..... C23F 11/16; C23F 11/10

[58] Field of Search ..... 252/389 A, 8.55 E, 181; 260/502.5; 21/2.7 A, 2.5 A; 210/58, 59

[56] References Cited

UNITED STATES PATENTS

| | | | |
|---|---|---|---|
| 3,288,846 | 11/1966 | Irani et al. | 260/502.5 |
| 3,298,956 | 1/1967 | Irani et al. | 252/389 A |
| 3,354,215 | 11/1967 | Garner | 252/389 A |
| 3,483,133 | 12/1969 | Hatch et al. | 252/389 A |
| 3,668,237 | 6/1972 | Cyba | 252/389 A |
| 3,705,005 | 12/1972 | Cervi et al. | 252/389 A |
| 3,969,260 | 7/1976 | Clark | 252/389 A |

*Primary Examiner*—Richard E. Schafer
*Assistant Examiner*—Irwin Gluck
*Attorney, Agent, or Firm*—S. M. Tarter; E. P. Grattan; F. D. Shearin

[57] ABSTRACT

Phosphonomethyl amino carboxylates of the general formula

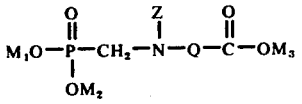

wherein $M_1$, $M_2$ and $M_3$ are each hydrogen, metal ion, ammonium ion or alkyl ammonium ion, Z is $-CH_2PO_3M_1M_2$, $C_{1-4}$ alkanol, $C_{1-4}$ alkyl carboxylic acid, or $C_{1-10}$ alkaminomethylene phosphonic acid radical, and Q is $C_{3-15}$ alkylene, $C_{3-15}$ alkenylene, or alkaryl radical are useful alone or in combination with one or more conventional corrosion inhibitor compounds to inhibit the corrosion of metals in aqueous systems.

35 Claims, No Drawings

METHOD OF CORROSION INHIBITION AND COMPOSITIONS THEREFOR

BACKGROUND OF THE INVENTION

The present invention relates to methods of inhibiting corrosion of metal surfaces in contact with an aqueous medium of corrosive nature. More particularly, this invention relates to methods of inhibiting the corrosion of metal surfaces by utilizing in the corrosive aqueous medium certain phosphonomethyl amino carboxylates either alone or in combination with one or more other corrosion inhibitor compounds.

The present invention has special utility in the prevention of the corrosion of metals which are in contact with circulating water, that is water which is moving through condensers, engine jackets, cooling towers, evaporators or distribution sytems; however, it can be used to prevent the corrosion of metal surfaces in other aqueous corrosive media. This invention is especially valuable in inhibiting the corrosion of ferrous metals including iron and steel, and also galvanized steel, nonferrous metals including copper and its alloys, aluminum and its alloys and brass. These metals are generally used in circulating water systems.

The major corrosive ingredients of aqueous cooling systems are primarily dissolved oxygen and inorganic salts, such as the carbonate, bicarbonate, chloride and/or sulfate salts of calcium, magnesium and/or sodium. Other factors contributing to corrosion are pH and temperature. Generally an increase in the temperature and a decrease in the pH accelerates corrosion.

It is well-known that certain corrosion inhibiting compositions of organic phosphonates are enhanced in their effectiveness by the addition of zinc salts and/or chromates to the inhibiting composition. However, the use of zinc salts and chromates has been found in recent years to adversely affect water quality when released in natural waters. Removal of the zinc and/or chromate ions by precipitation or other treatments is complicated and expensive. Consequently, effective corrosion inhibiting compositions free of such heavy metal ions are now desired by industry for protection of metallic equipment without the accompanying disadvantages of the heavy metal ions previously employed.

SUMMARY OF THE INVENTION

It is a primary object of this invention to provide new corrosion inhibiting methods for metals.

It is another object of this invention to provide new corrosion inhibiting methods for ferrous metals and nonferrous metals in contact with an aqueous corrosive medium.

It is another object of this invention to provide new corrosion inhibiting compositions.

It is another still further object of this invention to provide new corrosion inhibiting compositions for ferrous metals including iron and steel, and nonferrous metals including copper and brass.

It is a particular object of this invention to provide new methods for inhibiting corrosion of ferrous metals including iron and steel and nonferrous metals including copper and brass in cooling water systems.

Other advantages and objects of the present invention will be apparent from the following discussion and appended claims.

It has been found that certain phosphonomethyl amino carboxylates unexpectedly function as excellent corrosion inhibitors and do not require the presence of heavy metal ions to be effective, although they can be used in conjunction with all well-known water treating composition ingredients without being adversely affected in their corrosion inhibition properties. The nature of these phosphonomethyl amino carboxylates and methods for use thereof as corrosion inhibitors are more fully set out in the description of preferred embodiments below.

DESCRIPTION OF PREFERRED EMBODIMENTS

The phosphonomethyl amino carboxylates useful in the present invention are defined according to Formula I below. Formula I includes salts, partial salts, acids and partial acids, and mixtures of such compounds, all of which are generically described and hereinafter referred to as "phosphonomethyl amino carboxylates" abbreviated as "PMAC".

These phosphonomethyl amino carboxylates correspond to the formula:

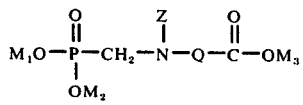

(I)

wherein $M_1$, $M_2$ and $M_3$ are each individually selected from the group consisting of hydrogen, metal ions, ammonium ions or alkyl ammonium ions, Z is $-CH_2PO_3M_1M_2$, $C_{1-4}$ alkanol, $C_{1-4}$ alkyl carboxylic acid, or $C_{1-10}$ alkaminomethylene phosphonic acid, and Q is selected from the group consisting of $C_{3-15}$ alkylene, $C_{3-15}$ alkenylene, or alkaryl radicals.

With respect to $M_1$, $M_2$ and $M_3$, useful metal ions include, for example, alkali metals such as sodium, lithium, and potassium; alkaline earth metal such as calcium and magnesium; aluminum, zinc, cadmium, manganese, nickel, cobalt, lead, tin, iron, chromium and copper. The preferred metal ions are those which produce a salt which is soluble in aqueous corrosive media in concentrations sufficient for corrosion inhibition, the generally preferred metal ions being sodium, potassium and zinc. Where the metal ions are monovalent, each metal ion will replace an $M_1$, $M_2$ or $M_3$ on a 1 to 1 basis. Where the metal ions are divalent or trivalent, each metal ion will replace two or three M radicals respectively which may be any combination of $M_1$, $M_2$ and $M_3$ and may be from the same or different PMAC molecules.

In addition to the preferred ammonium ion as an M radical, useful alkyl ammonium radicals which produce water-soluble salts are those derived from amines having a molecular weight below about 300, and more particularly from alkyl amines, alkylene polyamines, and alkanol amines containing from 1 to about 10 carbon atoms such as, for example, ethyl amine, diethyl amine, ethylene diamine, diethylene triamine, triethylamine, propyl amine, propylene diamine, hexyl amine, 2-ethylhexylamine, N-butylethanol amine, triethanol amine, and the like.

In addition to the preferred value of Z as a methyl phosphonate group, Z can be $C_{1-4}$ alkanol such as hydroxy methyl or hydroxy ethyl groups, $C_{1-4}$ alkyl carboxylic acid such as carboxy methyl or carboxy ethyl, or a $C_{1-10}$ alkaminomethylene phosphonic acid radical. Where Z is an alkaminomethylene phosphonic acid radical, useful radicals include those of the formula $-RN(R')CH_2PO_3M_1M_2$ wherein R is alkylene or alkenylene containing from 1 to about 10 carbon atoms and R′ is $-CH_2PO_3M_1M_2$, $C_{1-4}$ alkanol, or $C_{1-4}$ alkyl carboxylic acid.

With respect to Q, useful alkylene and alkenylene radicals are those containing 3 to about 15 carbon atoms and may be aliphatic or alicyclic, the alicyclic radicals usually containing from 4 to 10 carbon atoms. Useful alkaryl radicals are benzyl, phenylethyl and the like. The Q radicals may be unsubstituted or substituted with $C_{1-6}$ alkyl, halogen, or hydroxyl radicals wherein the halogen is chlorine, fluorine, or bromine. Generally, the most preferrred PMAC are those wherein the Q radical is an alkylene radical of from 3 to 6 carbon atoms.

Representative examples of some PMAC compounds including within the present invention are illustrated below:

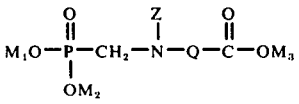

(I)

TABLE I

| Compound No. | $M_1$ | $M_2$ | $M_3$ | Q | Z |
|---|---|---|---|---|---|
| 1 | H | H | H | $(CH_2)_3$ | $CH_2PO_3H_2$ |
| 2 | " | " | " | $(CH_2)_5$ | " |
| 3 | " | " | " | $(CH_2)_7$ | " |
| 4 | " | " | " | $(CH_2)_{10}$ | " |
| 5 | " | " | " | $(CH_2)_{11}$ | " |
| 6 | " | " | " | $(CH_2)_{12}$ | " |
| 7 | " | " | $C_2H_5NH_3$ | $(CH_3CCH_3)_5$ | " |
| 8 | " | " | H | $(CH_3CCH_3)_5$ | " |
| 9 | " | " | $C_2H_5NH_3$ | $(CH_2)_5$ | " |
| 10 | " | " | H | $C_6H_{10}$ | " |
| 11 | " | " | " | $CH_2C_6H_4$ | " |
| 12 | Na | " | " | $(CH_2)_5$ | $CH_2PO_3NaH$ |
| 13 | Zn | " | " | " | $CH_2PO_3ZnH$ |
| 14 | $NH_4$ | " | " | " | $CH_2PO_3(NH_4)H$ |
| 15 | Na | Na | H | $(CH_3CCH_3)_5$ | $CH_2PO_3Na_2$ |
| 16 | Zn | Zn | " | " | $CH_2PO_3Zn$ |
| 17 | $NH_4$ | $NH_4$ | " | " | $CH_2PO_3(NH_4)_2$ |
| 18 | $C_2H_5NH_3$ | $C_2H_5NH_3$ | " | $(CH_2)_5$ | $CH_2PO_3(C_2H_5NH_3)_2$ |
| 19 | H | H | " | $(CH_2)_3$ | $(CH_2)_3N(CH_2PO_3H_2)_2$ |
| 20 | " | " | " | " | $(CH_2)_3N(CH_2COOH)(CH_2PO_3H_2)$ |
| 21 | " | " | " | " | $(CH_2)_3N(CH_2CH_2OH)(CH_2PO_3H_2)$ |
| 22 | " | " | " | $(CH_2)_5$ | $(CH_2)_2N(CH_2COOH)_2$ |
| 23 | " | " | " | " | $(CH_2)_3N(CH_2CH_2OH)_2$ |

The PMAC compounds falling within the foregoing Formula I can be prepared according to the method of copending patent application of Robert S. Mitchell, Ser. No. 361,383, filed May 17, 1973, which method is incorporated herein by reference.

The PMAC of the present invention inhibit corrosion of metal surfaces in contact with aqueous corrosive media, and particularly oxygen-bearing waters. It has been found that to effectively inhibit corrosion at least 3 ppm, preferably from about 10 ppm to about 500 ppm, and more preferably from about 10 ppm to about 150 ppm of the PMAC compound should be utilized in the corrosive medium. It is to be understood that greater than 500 ppm of these compounds can be used if desired so long as the higher amounts are not detrimental to the water system. Amounts as low as 1 ppm are found to be effective under some conditions.

The PMAC corrosion inhibitors of the present invention are effective in both acidic and basic corrosive media. The pH can range from about 4 to about 12. In cooling towers the water system is generally maintained at a pH of from about 6.5 to 10.0, and most often at a pH of from about 6.5 to 8.5. In all such systems the inhibitors of the present invention are effective.

In addition to the utilization of the PMAC of the present invention per se as corrosion inhibitors, they may be successfully employed together with the zinc ion or chromates or dichromates. That is, the use of the PMAC with the zinc ion, a chromate or dichromate or both the zinc ion and chromate or dichromate effectively inhibits corrosion. The zinc ion and chromate or dichromate is preferably used in the same concentration as the PMAC compound, e.g., from about 1 to 100 ppm of zinc ion and 1 to 100 ppm of chromate or dichromate and preferably from about 5 to 25 ppm of the zinc ion and/or 5 to 25 ppm of chromate or dichromate. It is to be understood that the present invention emcompasses a corrosion inhibiting process utilizing mixtures of the PMAC compounds of this invention and a zinc-containing material, i.e., a zinc compound soluble in the corrosive media, which is capable of forming the zinc ion in an aqueous medium and/or any compound of hexavalent chromium soluble in the aqueous medium, preferably an alkali metal or ammonium chromate or dichromate or chromic acid. It is understood that the zinc ion can be supplied wholly or in part by using the zinc salt of the acid form of the PMAC compound.

The PMAC compound and the zinc-containing material, e.g., the water-soluble zinc salt, and/or a chromate or dichromate may be mixed as a dry composition and fed into a water system to be inhibited, or they may be added individually or as concentrated aqueous solutions. Compositions demonstrating maximum corrosion inhibition of PMAC and zinc salt generally comprise from about 10 to about 80 percent by weight of the water-soluble zinc salt and from 20 to 90 percent by weight of PMAC based upon the total weight of the mixture. Preferably the composition comprises from about 20 to about 60 percent by weight of a water-soluble zinc salt and from about 40 to about 80 percent by weight of PMAC. A composition providing a concentration of about 3 to 300 ppm of PMAC and about 2 to about 300 ppm zinc ion in the water system will inhibit corrosion in most water systems, and the most preferred concentration range is from about 5 to 75 ppm PMAC and from about 5 to 25 ppm zinc ion. In the case of the use of chromate, an effective corrosion inhibitor composition generally comprises a mixture of from 1 percent to about 60 percent and preferably from 10 percent to about 40 percent of a water soluble inorganic chromate based on the total weight of the chromate and PMAC.

As indicated above, it is within the scope of the present invention to provide a corrosion inhibiting composition containing PMAC, a water soluble zinc salt as hereinabove described and from about 1 to 60 percent by weight PMAC of a hexavalent compound of chromium. Especially useful combinations of PMAC, chromate and zinc exist in the range of from about 1 to 100 ppm of PMAC, from 1 to about 100 ppm of chromate or dichromate, and from 1 to about 100 ppm zinc ion. The preferred range is from about 2 to 30 ppm of PMAC, from 1 to about 15 ppm of chromate or dichromate, and from about 1 to about 15 ppm of zinc ion. As indicated, concentrations outside these defined ranges are also useful and the invention is not to be limited to the illustrative concentrations set forth herein.

Where the water systems are in contact with various metals such as steel and copper or copper-containing metals, it is frequently desirable to use, along with the PMAC, either alone or in combination with zinc and/or chromium ions, a 1,2,3-triazole or a thiol of a thiazole, an oxazole, or an imidazole such as are known in the art to inhibit the corrosion of copper. These azoles are likewise effective with the PMAC of the present invention. The amounts of the azoles used depend on the particular aqueous systems. Generally concentrations of about 0.05 to 5 ppm of thiol or triazole with about 3 to 100 ppm PMAC and up to about 100 ppm zinc ion are satisfactory, preferably concentrations of from about 0.5 to 2 ppm of the azole, from about 5 to 25 ppm PMAC and, if desired, from about 5 to 25 ppm zinc ion. A dry composition or an aqueous solution may be made which can be fed into the water system containing the various metals. Such a composition would consist of PMAC and zinc as hereinabove detailed and in addition about 1 percent to 10 percent by weight of the PMAC of thiol or 1,2,3-triazole.

It is within the scope of the present invention that the PMAC corrosion inhibitors of this invention may also be used in aqueous systems which contain inorganic and/or organic materials (particularly, all ingredients or substances used by the water-treating industry), with the proviso that such materials do not render the PMAC substantially ineffective for corrosion inhibition. These organic and inorganic materials include, without limitation, polycarboxylates, particularly those whose molecular weights are from about 2,000 to about 20,000 and from about 20,000 to about 960,000; antifoam agents; water soluble polymers such as polyacrylic acid, polyacrylamide, partially hydrolyzed acrylamide, sulfonated polyacrylates and polyacrylamides and the like; tannins; lignins; deaerating materials; polymeric anhydrides (such as polymaleic anhydride); and sulfonated lignins. Other materials which can be used with said inhibitors include, for example, chelating and sequestering agents, surface active agents, acetodiphosphonic acids and salts thereof, molybdates, nitrites, nitrates, ferrocyanides, boron compounds, inorganic phosphates including orthophosphates, molecularly dehydrated phosphates and phosphonates, sulfophosphonates, organic phosphates such as polyfunctional phosphated polyol esters, calcium and magnesium salts such as calcium or magnesium chlorides, sulfates, nitrates and bicarbonates and inorganic silicates. Furthermore, scale and precipitation inhibitors such as amino alkylene phosphonic acids may be used in combination with the PMAC inhibitors of the present invention. For exemplary purposes only, these other precipitation inhibitors are described in U.S. Pat Nos. 3,243,124, 3,336,221, 3,393,150, 3,400,078, 3,400,148, 3,434,969, 3,451,939, 3,462,365, 3,480,083, 3,591,513, 3,597,352 and 3,644,205. Other corrosion inhibitors can be used in combination with the PMAC of the present invention, including those described in U.S. Pat. Nos. 3,483,133, 3,487,018, 3,518,203, 3,532,639, 3,580,855, and 3,592,764.

The following examples are included to illustrate the practice of the present invention and the advantages provided thereby but are not to be considered limiting. Unless other specified, all parts are parts by weight and all temperatures are in degrees centigrade.

EXAMPLE I

The effectiveness of the PMAC compounds of this invention as inhibitors of the corrosion of metals by oxygenated waters is shown by tests determining metallic corrosion rates. The tests are conducted in polarization test cells employing steel electrodes with synthetic, very hard municipal water at an initial pH of 7.0 and continuous aeration. The concentrations of the inhibitors are calculated on the basis of active acid form of the PMAC compound and the test carried out at two concentrations of 50 and 150 ppm in the synthetic hard water test medium. The rates of corrosion are determined by the Tafel Slope Extrapolation Method as described in "Handbook of Corrosion, Testing and Evaluation" by Dean, France and Ketchum published by Wiley-Intersciences, New York (1971), Chapter 8, from the observed current densities and are expressed in terms of mils per year of metal loss. The corrosion rates of the steel electrodes, when protected by the test concentrations of the corrosion inhibitors tested, can then be compared to the corrosion rate of those electrodes when unprotected by a corrosion inhibitor. The decrease in the corrosion rate expressed in mils per year indicates the effectiveness of the corrosion inhibitor. In tests of this nature, where the aqueous corrosive medium is synthetic hard municipal water at only slightly elevated temperature, any corrosion rate less than the corrosion rate of the medium alone is desired and rates of less than about 10 mils per year are highly desired and substances that give this rate or lower are considered excellent.

The synthetic hard municipal water used in the test described is prepared to approximate hard municipal water as concentrated by operation of a cooling tower and is composed of:

| INGREDIENTS | MG/L |
|---|---|
| Calcium | 88 |
| Magnesium | 24 |
| Chloride | 70 |
| Sulfate | 328 |
| Bicarbonate | 40 |
| Total hardness as $CaCO_3$ in distilled water | 319 |

The corrosion rates of a steel electrode at 35° C. in the synthetic hard municipal water medium adjusted to an initial pH of 7.0, described above, without added inhibitor and containing the indicated concentration of Compound 1, Compound 2 and Compound 11 are determined as discussed above by the Tafel Slope Extrapolation Method. When the acid forms of the PMAC are added to the synthetic water medium and the initial pH adjusted to 7 by means of sodium hydroxide, the form the PMAC present in each solution is generally that of the disodium salt, i.e. wherein $M_1$ is sodium and the remaining M groups are hydrogen. The results are set out in Table II below:

TABLE II

| Test Compound | Concentration of Corrosion Inhibitor (ppm) | Corrosion Rate (m.p.y.) |
|---|---|---|
| Control | None | 42 |
| 1 | 50 | 6 |
| | 150 | 0.7 |
| 2 | 50 | 2 |
| | 150 | 3 |
| 11 | 50 | 1.7 |
| | 150 | 0.7 |

EXAMPLE II

Corrosion rate tests are conducted in the same manner as in Example I above with Compounds 3, 5, 7, 10, 14, 18 and 19 of Table I at the same two concentrations of active PMAC inhibitor. The results obtained utilizing these PMAC compounds show rates of corrosion ranging from about 2 to 12 mils per year in the same corrosive aerated synthetic water medium.

EXAMPLE III

The effectiveness of corrosion inhibitor compositions containing the PMAC compounds of the present invention in synthetic cooling tower water is determined according to a standard batch corrosion test procedure. In accordance with this procedure, three test coupons of No. 1010 AISI steel measuring approximately 1.6 by 3.2 cm are cleaned, dried and weighed. The coupons are then individually suspended in a beaker containing 1200 ml of test water and various amounts of inhibitors. The test solution is agitated, aerated and temperature controlled for a test period of several days. Agitation is achieved with a polyethylene propeller type agitator driven by an overhead stirrer and aeration is achieved by bubbling filtered air through a coarse gas dispersion tube at a controlled rate. Details of the test, including water composition, inhibitor concentration, pH, test temperature and test duration are provided hereinafter.

Upon conclusion of the test period, the coupons are removed, cleaned by brushing with a fine pumice soap, rinsed with distilled water and acetone, dried and reweighed to determine corrosion losses. The corrosion rate in mils per year is calculated according to the following equation:

$$\text{Corrosion Rate, } m.p.y. = KW/DAT$$

wherein $W$ = weight loss during test in milligrams;
$D$ = specific gravity of the metal;
$A$ = exposed surface area in square cm;
$T$ = time of exposure to solution in hours;
$K$ = 3402; and
$m.p.y.$ = mils of penetration per year Synthetic cooling water is prepared to approximate actual cooling water, which has been concentrated by continuous circulation, and has the following composition:

| INGREDIENTS | ppm |
|---|---|
| Calcium | 117 |
| Magnesium | 74 |
| Sodium | 242 |
| Chloride | 90 |
| Sulfate | 725 |
| Bicarbonate | 143 |
| Total Dissolved Solids of Distilled Water | 1391 |

As can be seen from the formulation above, a circulating cooling water system contains a concentration of inorganic salts or ions which is much higher than oridinary tap water. A cooling water system is also operated at elevated temperatures, usually 50° C. or higher. Primarily because of these factors, the commercially acceptable corrosion rate in cooling water systems is less than about 10 m.p.y., and corrosion inhibitors and inhibitor compositions producing corrosion rates less than this amount are considered good and commercially acceptable.

The present invention is further illustrated by the following example conducted according to the above procedure and under the following conditions:

| | |
|---|---|
| Inhibitor Composition | See TABLE III |
| Temperature | 50° C. |
| Initial pH | 7.0 ± 0.1 |
| Duration | 6 days |

TABLE III

| Inhibitor Composition | Molar Ratio Zn/Inhibitor | Final pH | Corrosion Rate, m.p.y. |
|---|---|---|---|
| A. None (Blank Control) | — | 7.9 | 44.1 |
| B. $ZnSO_4 . 7H_2O$ (Control) | — | 8.0 | 36.0 |
| C. $ZnSO_4 . 7H_2O$ + | | | |
| 25 ppm $N(CH_2PO_3H_2)_2(CH_2)_5COOH$ | 2:1 | 8.1 | 17.9 |
| 25 ppm " | 3:1 | 8.2 | 10.6 |
| 50 ppm " | 1:1 | 7.9 | 14.8 |
| 50 ppm " | 2:1 | 7.1 | 0.7 |
| 50 ppm " | 3:1 | 7.1 | 0.2 |

The blank solution containing no zinc or PMAC corrosion inhibitor defines the corrosion rate of the mild steel coupons in untreated synthetic cooling water. The test data show that while zinc alone does little to reduce the corrosion rate, the combination of zinc and the PMAC compound is effective to reduce the corrosion rate to less than 1.0 m.p.y. Since a corrosion rate of 10 m.p.y. is generally considered to be an acceptable rate, the excellent corrosion protection afforded by the compositions of this invention can be readily appreciated.

Comparable results on the inhibition of corrosion of mild steel are obtained with other PMAC compounds as defined in Formula I hereinabove. The combination of zinc and PMAC compounds are also effective to reduce the corrosion rate of copper and copper containing metals, particularly with the addition of a specific copper corrosion inhibitor such as 1,2,3-triazole and thiols of thiazoles, oxazoles, or imidazoles as described above.

It is also within the scope of the present invention to provide a corrosion inhibiting method employing inorganic silicates, inorganic phosphates, polyacrylates and polyacrylamides in combination with the PMAC compounds. These silicates, phosphates and polymers can be used in the same ppm concentration as the water-soluble zinc salts hereinbefore described.

The foregoing examples have been described in the specification for the purpose of illustration and not limitation. The corrosion inhibiting PMAC compounds of this invention can be employed in a number of forms which will give good protection against corrosion. For example, the PMAC compounds either in the form of acid or salts, alone or in combination with other corrosion inhibiting materials, as outlined above, including thiols, 1,2,3-triazoles, water soluble zinc salts, chromates, silicates, inorganic phosphates, other phosphonates, molybdates, tannins, lignins, lignin sulfonates, nitrites, nitrates, borates and calcium and magnesium salts, can simply be dissolved by mixing them into the aqueous medium. In another method they can be dissolved separately in water or another suitable solvent and then intermixed with the aqueous medium.

Various means are available to insure that the correct proportion of corrosion inhibitor is present in the aqueous medium. For example, a solution containing the said PMAC inhibitor can be metered into the aqueous medium by drop feeder. Another method is to formulate tablets or briquettes of a PMAC compound, with other ingredients which are solids, and these can be added to the aqueous medium. For example, a compressed ball of standard weight and dimension can be prepared containing 38 parts of PMAC Compound No. 2, 50 parts of leachable inert solids and 12 parts of a lignosulfite binder. The above formulation, after briquetting, can be used in a ball feeder so that the formulation is released slowly into the aqueous medium.

Thus, it is apparent that the present invention relates to corrosion inhibiting compositions which comprise the PMAC compounds as defined by Formula I above. The invention is accordingly not to be limited to any compound, composition, or method disclosed herein for the purpose of illustrating the present invention.

What is claimed is:

1. A method of inhibiting the corrosion of metals in a water system comprising maintaining in the water of said system at least 1 part per million of phosphonomethyl amino carboxylate having the general formula

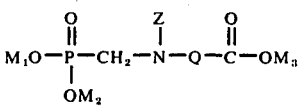

wherein $M_1$, $M_2$ and $M_3$ are individually selected from the group consisting of hydrogen, metal ions, ammonium ions, and alkyl ammonium ions containing up to about 10 carbon atoms; Z is $—CH_2PO_3M_1M_2$, $C_{1-4}$ alkanol, $C_{1-4}$ alkyl carboxylic acid or $C_{1-10}$ alkaminomethylene phosphonic acid; and Q is selected from the group consisting of $C_{3-15}$ alkylene, $C_{3-15}$ alkenylene, and alkaryl radicals.

2. The method of claim 1 wherein $M_1$, $M_2$ and $M_3$ are each hydrogen.

3. The method of claim 1 wherein $M_1$, $M_2$ and $M_3$ are each an alkali metal ion or hydrogen.

4. The method of claim 1 wherein $M_1$, $M_2$ and $M_3$ are each an ammonium ion or hydrogen.

5. The method of claim 1 wherein Q is a $C_{3-6}$ alkylene radical.

6. The method of claim 1 wherein the water of said system additionally contains from about 1 to about 100 ppm of a zinc compound soluble in said water system.

7. The method of claim 1 wherein the water of said system additionally contains a compound of hexavalent chromium soluble in said water system.

8. The method of claim 1 wherein the water of said system additionally contains from about 1 to about 100 ppm of a water-soluble compound of hexavalent chromium and from about 1 to about 100 ppm of a zinc compound soluble in said water system.

9. The method of claim 9 wherein the water of said system additionally contains a compound selected from the group consisting of 1,2,3-triazoles, thiols of thiazoles, thiols of oxazoles, thiols of imidazoles and mixtures thereof.

10. The method of claim 1 wherein Z is $—CH_2PO_3M_1M_2$.

11. The method of claim 1 wherein the said compound is bis(phosphonomethyl) amino propylene carboxylic acid.

12. The method of claim 1 wherein the said compound is bis(phosphonomethyl) amino pentamethylene carboxylic acid.

13. The method of claim 1 wherein the said compound is bis(phosphonomethyl) amino benzyl-4-carboxylic acid.

14. The method of claim 8 wherein the said carboxylate compound is bis(phosphonomethyl) amino pentamethylene carboxylic acid.

15. The method of claim 9 wherein the said carboxylate compound is bis(phosphonomethyl) amino pentamethylene carboxylic acid.

16. The method of claim 11 wherein the said compound is the disodium salt of said acid.

17. The method of claim 12 wherein the said compound is the disodium salt of said acid.

18. The method of claim 9 wherein the water system additionally contains from about 1 to about 100 ppm of a water-soluble zinc salt.

19. The method of claim 1 wherein the metal in the water system comprises a ferrous metal.

20. The method of claim 1 wherein the water system additionally contains a water soluble polymer selected from the group consisting of polyacrylates, polyamides, partially hydrolyzed polyacrylamides, sulfonated polyacrylates and sulfonated polyacrylamides.

21. The method of claim 1 wherein the water system additionally contains an inorganic phosphate.

22. The method of claim 1 wherein the water system additionally contains from about 1 to about 100 ppm of a water-soluble silicate.

23. The method of inhibiting corrosion of ferrous metals in a water system comprising maintaining in the water of said system from about 3 to about 150 ppm of a phosphonomethyl amino carboxylate having the formula $$(H_2O_3PCH_2)_2 - N - (CH_2)_{3\text{-}6} - COOH$$

or its water-soluble salts.

24. A composition comprising from about 10 percent to about 80 percent by weight of a water-soluble zinc salt and from about 20 percent to 90 percent by weight of a phosphonomethyl amino carboxylate having the general formula

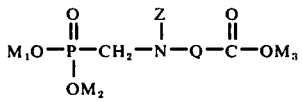

wherein $M_1$, $M_2$ and $M_3$ are individually selected from the group consisting of hydrogen, metal ions, ammonium ions, and alkyl ammonium ions containing up to about 10 carbon atoms; Z is $-CH_2PO_3M_1M_2$, $C_{1\text{-}4}$ alkanol, $C_{1\text{-}4}$ alkyl carboxylic acid or $C_{1\text{-}10}$ alkaminomethylene phosphonic acid; and Q is selected from the group consisting of $C_{3\text{-}15}$ alkylene, $C_{3\text{-}15}$ alkenylene and alkaryl radicals.

25. A composition of claim 24 wherein $M_1$, $M_2$ and $M_3$ are each hydrogen.

26. A composition of claim 24 wherein at least one of $M_1$, $M_2$ and $M_3$ is an alkali metal ion.

27. A composition of claim 24 wherein at least one of $M_1$, $M_2$ and $M_3$ is ammonium ion.

28. A composition of claim 24 wherein the water-soluble zinc salt is zinc sulfate and at least one of $M_1$ and $M_2$ is sodium.

29. A composition of claim 24 additionally containing from 1 percent to about 60 percent by weight of said carboxylate of a water-soluble hexavalent compound of chromium.

30. A composition of claim 24 wherein the phosphonomethyl amino carboxylate has the formula $$(H_2O_3PCH_2)_2 - N - (CH_2)_5 - COOH.$$

31. A composition of claim 30 wherein the zinc salt is zinc sulfate, and the ratio of zinc ion to phosphonomethyl amino carboxylate is from 1:1 to 3:1.

32. A composition of claim 24 wherein the phosphonomethyl amino carboxylate is bis(phosphonomethyl) amino propylene carboxylic acid.

33. A composition of claim 24 wherein the phosphonomethyl amino carboxylate is bis(phosphonomethyl) amino benzyl-4-carboxylic acid.

34. A composition of claim 24 additionally containing from 1 percent to about 10 percent by weight of said carboxylate of a compound selected from the group consisting of 1,2,3-triazoles, thiols of thiazoles, thiols of oxazoles, thiols of imidazoles, and mixtures thereof.

35. A composition of claim 34 and additionally containing from 1 percent to about 60 percent by weight of said carboxylate of a water-soluble hexavalent compound of chromium.

* * * * *

UNITED STATES PATENT OFFICE
CERTIFICATE OF CORRECTION

PATENT NO. : 4,033,896

DATED : July 5, 1977

INVENTOR(S) : Robert S. Mitchell and Thomas M. King

It is certified that error appears in the above-identified patent and that said Letters Patent are hereby corrected as shown below:

Column 3, line 16, "including" should be corrected to read "included".

Column 4, line 57, after "to" should be inserted -- about --.

Column 6, line 6, "3,243,124" should be corrected to read "3,234,124".

Column 7, line 69, "KW/DAT" should be corrected to read "$\frac{\text{KW}}{\text{DAT}}$".

Column 10. line 1 of Claim 9, "claim 9" should be corrected to read "claim 1".

Signed and Sealed this

***Twenty-fifth* Day of *October 1977***

[SEAL]

*Attest:*

RUTH C. MASON
*Attesting Officer*

LUTRELLE F. PARKER
*Acting Commissioner of Patents and Trademarks*